United States Patent [19]

Woods et al.

[11] Patent Number: 4,490,921

[45] Date of Patent: Jan. 1, 1985

[54] DRAFTING TOOL

[75] Inventors: William D. Woods; John H. Pigman, both of Tempe, Ariz.

[73] Assignee: International Design Corporation, Phoenix, Ariz.

[21] Appl. No.: 417,136

[22] Filed: Sep. 13, 1982

[51] Int. Cl.[3] ..... B43L 9/00

[52] U.S. Cl. ..... 33/476; 33/1 N; 33/27 C; 33/494

[58] Field of Search ..... 33/1 N, 27 B, 476, 474, 33/27 C, 494, 1 B

[56] References Cited

U.S. PATENT DOCUMENTS

| | | | |
|---|---|---|---|
| 239,691 | 4/1881 | Appleton | 33/494 |
| 647,339 | 4/1900 | Thompson | 33/1 N |
| 1,043,789 | 11/1912 | Whalen | 33/494 |
| 1,182,638 | 5/1916 | Carnahan | 33/474 |
| 2,003,172 | 5/1935 | Burt | 33/1 N |
| 2,016,489 | 10/1935 | Escalante | 33/476 |
| 3,795,053 | 3/1974 | Burke | 33/27 C |

FOREIGN PATENT DOCUMENTS

| | | | |
|---|---|---|---|
| 905466 | 4/1945 | France | 33/1 N |

*Primary Examiner*—William D. Martin, Jr.
*Attorney, Agent, or Firm*—LaValle D. Ptak

[57] ABSTRACT

A drafting tool for use in drafting or work layout is made of a pocket-sized piece of flat, transparent, rectangular material. The opposite edges are marked with full-scale and half-scale rulers and a center line is marked connecting the mid points of these rulers. This center line is perpendicular to both reference edges, and at least one of the rulers is marked with units in increasing dimension toward both ends of the reference edge starting with zero at the center line. The base line of a protractor is spaced inwardly from one of the reference edges and is parallel to that reference edge. The protractor itself is layed out in the form of a trapezoid, the top of which is parallel to the base line and the two sides of which slope inwardly from the base line toward the top at forty-five degree angles. The connections of these sides with the top is at an angle of sixty degrees with the base line measured at the origin on opposite sides of the center line. A small hole is formed through the tool at the origin of the protractor, and a number of spaced holes are formed through the base line in alignment with the markings of the ruler nearest the base line for use in striking circles of various diameters.

8 Claims, 1 Drawing Figure

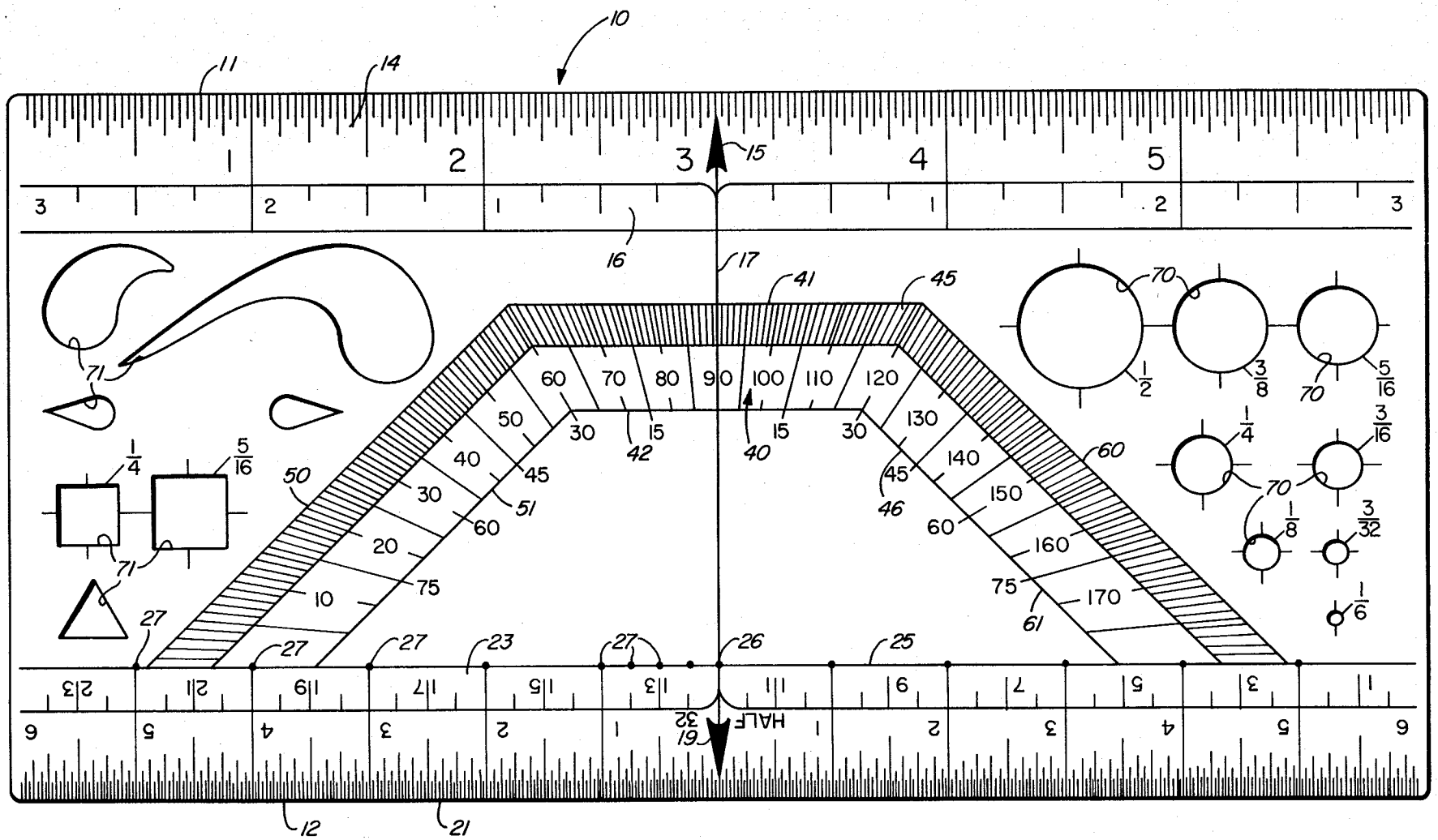
HALF
10
11
12
14
15
16
17
21
23
25
26
27
40
41
42
45
46
50
51
60
61
70
71
75

DRAFTING TOOL

RELATED APPLICATION

The subject matter of this application is related to the now-abandoned copending application Ser. No. 331,888, filed Dec. 17, 1981, entitled "CENTERLINE RULE", and assigned to the same Assignee as the present invention.

BACKGROUND OF THE INVENTION

In the drafting of line drawings such as employed for parts layout, architectural renderings, and the like a variety of highly specialized tools are commonly employed. First of all, a drafting board or table with a straight edge or its equivalent is required. Then, an assortment of drafting tools such as T-squares, rules, compasses, protractors, and various triangles of different angles are employed. When a draftsman uses such tools in laying out a drawing, much time is spent in picking up and setting down the various tools used at different times to draw lines at different angles, circles, and the like. In addition, since these various drafting tools, particularly as used by professional draftsmen and architects, must be accurate, they are relatively expensive.

Even with the variety of conventional tools which are mentioned above, the ability to quickly and accurately perform many functions required of a draftsman often is not facilitated by the tools themselves, but the draftsman must make various mental calculations. One commonly encountered layout problem which is solved by the centerline rule disclosed in the above-mentioned copending application is that of drawing a line of a particular length with a given reference point as a center point. This rule has a half scale and full scale with centered zero-point references displayed on the scales. These are interconnected by a perpendicular center line. Consequently, the tool permits a line of given length centered on a given point to be accurately and quickly determined and drawn, all in a single operation without any additional mathematical calculations or scale estimations. In addition, by employing the center line and windows, a line can be drawn across a reference line of known length on either side of and perpendicular to the reference line all in a single operation.

Various composite drafting tools employing lines on them at different angles, and many incorporating protractors or other angle determining devices, have been developed in the past. One example is illustrated in the Patent to VanNess, U.S. Pat. No. 1,154,673, issued Sept. 28, 1915. This patent discloses a forty-five degree right triangle with ruler scales scribed or printed along both legs of the triangle. In addition, a variety of lines at different angles are shown on the face of the triangle to assist its use in layout. A rotatable protractor is mounted in the center, and throughout the protractor and the triangle itself a large number of small holes (to accommodate the tip of a pencil) are placed with printed indicia adjacent them to permit the drawing of circles of various diameters by use of the tool. The rotatable protractor construction obviously makes this a relatively expensive tool. In addition, the placement of the holes for drawing circles is not convenient to use; and, since there is no scale directly adjacent the holes, the entire tool must be searched each time for the designation of the radius or diameter of the circle to be drawn. There is no center line or zero-point reference for facilitating drafting with this tool, so that mental calculations still must be made whenever it is used.

The Elger Patent, U.S. Pat. No. 3,289,299, is directed to a protractor having a configuration in which the protractor itself is printed or etched onto the face of a trapezoidal shaped base member. The top of the trapezoid is parallel to the bottom of the trapezoid which, in turn, serves as the base line for the protractor. The top and bottom are interconnected by converging oblique sides which make an angle of sixty degrees with respect to the base line of the protractor. This is an angle which is commonly encountered in drafting, so that the outside edges of the tool may be used directly to lay out lines at this angle. Also scribed on the face of the protractor are a large number of concentric circles each having a small hole on it to permit use of the tool to draw arcs or circles having the desired radii marked on the tool adjacent each of the concentric lines. While the tool of this patent is capable of somewhat specialized use as a protractor, it is not as universal a tool as the one disclosed in the VanNess Patent. Many of the shortcomings present in VanNess are also present in the tool of the Elger Patent.

Efforts to provide a tool which acts as a straight edge ruler and also includes the function of a protractor are disclosed in the Patents to Bryson U.S. Pat. No. 846,006, issued Mar. 5, 1907; and Owen, Jr., U.S. Pat. No. 1,808,705, issued June 2, 1931. The Patent to Bryson discloses an elongated ruler having both longitudinal and perpendicular transverse spaced lines on it. In addition, a protractor, with its origin near the center of one of the edges of the rule, is provided; and lines at various angles also are placed on the face of the ruler to facilitate its use as a layout drafting tool. The various lines on this tool permit it to be used to draw a variety of straight lines at various angles with respect to one another so that it greatly facilitates many layout operations. The tool, however, cannot be used for drawing and establishing curved lines. Thus, a compass or other type of device for accomplishing this is necessary. In addition, there is no provision for multiple scale measurements or for center line layouts which do not involve additional mathematical computations and measurements.

The Owen, Jr. Patent is similar to the ruler of Bryson except it has a rotatable eyelet mounted in it at the center point of circles which may be drawn by placing a pencil through a hole located at a measured distance from the eyelet. Thus, this tool is capable of use as a beam compass as well as a ruler and straight edge. The tool itself is rectangular and has a graduated English scale along one edge and a metric scale along the opposite edge on the long side. A protractor is also scribed on the face of the rule and has its origin at the center point of one of the edges of the tool.

It is desirable to provide a drafting tool for use in making a variety of layout drawings which overcomes the disadvantages of the various tools of the prior art mentioned above and which also permits additional functions to be performed directly by the user without requiring him to resort to the use of multiple tools of the type commonly employed by mechanical and architectural draftsmen.

SUMMARY OF THE INVENTION

Accordingly, it is an object of this invention to provide an improved drafting tool.

It is another object of this invention to provide an improved drafting tool capable of performing multiple functions.

It is an additional object of this invention to provide an improved multiple function drafting tool which may be carried in the pocket of the user.

It is a further object of this invention to provide an improved multiple function drafting tool which minimizes the mathematical computations required of the user and which facilitates the laying out of lines at various angles with respect to one another and the drawing of circles of various diameters, as well as other common drafting functions.

In accordance with a preferred embodiment of the invention, a drafting tool is made of flat, transparent material for use with a marking instrument. The tool itself includes at least one straight reference edge. A protractor base line is marked on the tool and is spaced from and parallel to the reference edge. A half-scale ruler is marked along either the reference edge or the protractor base line, with a half-scale zero-point marked at the midpoint of it. The half-scale units are marked in increasing dimensions toward both ends of the reference edge from the zero-point. A center line is marked on the tool perpendicular to the reference edge and the base line and intersecting the half scale zero-point. To facilitate the drawing of lines at various angles, a protractor is marked on the tool with its origin at the point where the center line intersects the base line. A plurality of spaced holes then are placed through the tool on the base line and are aligned with various marks of the half-scale rule. One of these holes is located at the origin of the protractor and the holes themselves are dimensioned to permit the passage of the point of a pencil through them for drawing circles using the tool.

BRIEF DESCRIPTION OF THE DRAWING

The single FIGURE of the drawing illustrates a preferred embodiment of the invention.

DETAILED DESCRIPTION

Referring now to the drawing, a drafting tool 10 is shown in the form of a flat, rectangular piece of transparent, rigid, dimensionally stable material 10. The parallel opposite edges 11 and 12 of the tool constitute very straight accurate reference edges. Along the upper edge 11, as shown in the drawing, there is a full-scale (English scale) rule 14 reading from left to right and having its center point indicated by an arrow 15. As illustrated in the drawing, this rule 14 is marked off in inches further broken down into 1/32" increments. The markings also indicate a typical length which has been found to be an ideal length for most applications. As shown, this is 6" and the width of the tool typically is half this or 3". While these length and width dimensions have been found to be a very useful and practical set of dimensions, it is understood that the tool could be made in other dimensions if desired.

Immediately below the left-to-right full-scale rule 14 is another full-scale rule 16, also marked off in inches. The rule 16, however, has the units of measure on it increasing toward both ends of the reference edge 11 from the zero-point or midpoint 15.

A center line 17, which is perpendicular to the parallel edges 11 and 12, extends across the face of the rule from the center point arrow 15 to a similar center point arrow 19 located on the opposite side adjacent the edge 12. It should be noted that the various markings which have been described so far and which are to be described may be placed on the otherwise transparent tool in any suitable manner. They may be printed directly on one or both faces. The markings also may be scribed or etched into the tool and filled with a contrasting color so that they readily may be seen, or they may be formed on a thin transparent sheet which is then sandwiched between two other sheets comprising the front and back faces of the tool. The manner in which the markings are applied is not important, but they must be applied in such a way that they are readily observable. At the same time, the main body portion of the tool 10 is transparent, so that any lines drawn on a paper located beneath the tool clearly show through the tool 10 itself.

Along the reference edge 12, a center reading half scale (English scale) 21 is marked. This scale is similar to the scale 16 in that it is marked with increasing units of measure starting at the zero-point or midpoint 19 and extending toward both of the opposite ends of the edge 12. This readily is ascertained by an examination of the scale 21 illustrated in the drawing. As in the case of the full-scale rule 14, the half-scale rule markings are broken down into half-inch, quarter-inch, eighth-inch, and one-thirty-second-inch increments.

A fourth rule 23, marked off in quarter scale, is placed adjacent the half scale and this scale reads from left to right (when the rule is turned over) in a manner similar to the reading of the scale 14. The edge 25 of the quarter scale rule which is furthest from the edge 12 also serves as the base line of a protractor marked off in the center of the tool. The line 25 is parallel to both of the straight reference edges 11 and 12, and the point where it crosses the perpendicular center line 17 is marked as point 26. This point constitutes the origin of the protractor. A small hole of sufficient size to accommodate the point of a pencil is formed through the tool 10 at this junction of the lines 17 and 25 to permit use of the tool as a beam compass.

The manner of use of the center line, and rules 14, 16, 21, and 23 is described in detail in the above-mentioned copending application, so that these functions will not be discussed here.

Additional uses of the tool illustrated in the drawing, however, which are not present in the aforementioned copending application are accomplished by means of the protractor, the base line 25, and other features which now will be described. Located along the base line 25 of the protractor, in addition to the hole 26, are a number of holes 27 which are precisely aligned with different ones of the markings on the half-scale rule 21. At each 1" of marking on the half-scale rule, a line extends all of the way from the reference edge 12 to the corresponding hole 27. This greatly facilitates the determination of the location of a particular hole 27 for the user of the tool.

Each of the holes 27 is made large enough to accommodate the point of a pencil, so that the device may be readily and accurately used as a compass. When used in this manner, the reading on the half-scale rule 21 directly corresponds to the actual diameter of a circle or arc drawn when the point 26 is used as a center. For example, if a pencil or pin is placed through the hole 26 and another pencil is placed through the hole 27 at the 1" marking on the half-scale rule, rotation of the tool by means of the pencil in the hole 27 about the pin or pencil at the hole 26 will draw a circle having a 1" diameter.

The protractor itself has an upper portion 40 with two parallel spaced-apart lines 41 and 42 defining this portion. The lines 41 and 42 are parallel to the reference edges 11 and 12 and, consequently, are perpendicular to the center line 17. To facilitate use of the protractor in conjunction with the other elements of the tool, the center line 17 bisects the protractor at its 90 degree point, as indicated by this marking on an upper scale 45 of the protractor. This upper scale 45 extends from left to right and measures angles directly from zero to 180 degrees from a horizontal axis constituting the base line 25. Another scale 46 is located beneath the scale 45 and is marked off along the lower edge of the protractor extending in opposite directions from the center line 17 in increasing amounts from 0 to 90 degrees to permit measurement in either direction in this manner from the vertical 90 degree axis formed by the center line 17.

The top lines 41 and 42 of the protractor each are interconnected by converging oblique lines at an angle of 45 degrees with respect to the base line 25 to form the two opposite sides of the protractor portion of the tool. These oblique lines constitute a pair of parallel lines 50 and 51 on the left side and a corresponding pair of parallel lines 60 and 61 on the right side of the protractor. The connection points of the oblique lines with the corresponding top lines 41 and 42 are at the 30/60 degree break points of the protractor. This provides a quick and accurate visual reference to these popular angular configurations. In addition, it is obvious from an examination of the tool shown in the drawing that the 45 degree lines 50, 51, 60, and 61 rapidly facilitate the drawing of lines at these angles with respect to any line previously drawn on the paper simply by aligning any of the lines 50, 51, 60, or 61 with the drawn line. Then a new line may be struck using the appropriate one of the reference edges 11 or 12 to draw the line. Similarly, lines at 30 degrees or 60 degrees also are accurately drawn by placing the break points between the junctions of the corresponding parallel sides of the protractor with the junctions of the lines 41 and 42 on a line on the paper. A connecting line extending at the proper angular configuration then may be drawn along either of the reference edges 11 or 12.

On the right-hand side of the tool, as shown in the drawing, a number of circular holes or apertures 70 are cut through the transparent material comprising the base of the tool. These holes are each marked with the corresponding diameter of the hole and are in sizes which are commonly used by draftsmen and architects. Center lines in the form of perpendicular crosses are extended beyond the holes and printed on the tool, so that the holes may be aligned over corresponding perpendicular crossed lines on the paper to permit them to be accurately located and used as a template for quickly drawing circles of these diameters.

As mentioned previously, circles of other diameters may be drawn by using the tool as a beam compass with a center point at the origin 26 of the protractor. Larger diameter holes may be drawn by using the center point at one of the points on one side of the center point 26 and placing the pencil for the circle to be drawn on the opposite side of the center point 26. For example, if a center of a circle is created at the 5" point 27 on the half-scale 21 to the left of the center line 17 and the point of the pencil which is used to scribe the circle around this point is placed at the corresponding 5" mark on the right hand side of the point 26, a 10" circle may be drawn with the tool. Thus, a large number of arcs and circles may be drawn with the device using the templates 70 and the points 26 and 27.

On the left-hand side of the tool is an additional set of cutouts or templates 71 comprising squares, french curves, a triangle, and arrowhead points. These are commonly employed drafting shapes and are readily and easily used by draftsmen and architects.

From an examination of the tool, it is apparent that the different scales provide direct application for use in making accurate scale drawings. In addition, the tool permits derivation of any scale right triangle with a single measurement and a connecting line. Even if the starting point is lost, the reference is regained by using the 90 degree line of the protractor. It also is possible to derive any scale equilateral triangle with only two angular measurements and a connecting line. The transparency of the tool and the orientation of the different markings on it greatly facilitate this operation.

The center line function using the line 17 permits accurate and rapid bisecting of lines and angles. In addition, it automatically permits derivation of the real dimension of a line measured from a given center. The use of the greater line permits multiplication of an unknown line length and multiplication of an unknown angle.

It is also readily apparent from an examination of the tool that it can be used automatically to convert full dimension to half dimension to quarter dimension without elaborate mathematical computations. The 45 degree protractor edge permits real scale readings from the center of one edge and from the end of the other without interpolation.

A variety of other uses and various modifications of the tool will occur to those skilled in the art. Accordingly, the tool which is shown in the drawing and which has been described above is to be considered illustrative of the invention and not as limiting of its scope.

We claim:

1. A drafting tool made of a rectangular piece of flat transparent material having a predetermined length and a predetermined width for use with a marking instrument including in combination:

first and second straight parallel reference edges comprising the outer edges of the length of said tool;

a protractor base line marked on said tool and spaced from and parallel to said first and second edges;

a half-scale ruler marked along at least said first straight reference edge or said base line, having a half-scale zero-point marked at the mid-point thereof, with half-scale units marked in increasing dimensions toward both ends of said first reference edge;

a centerline marked on said tool perpendicular to said reference edges and intersecting said base line and said half-scale zero-point;

a protractor marked on said tool with the origin thereof at the point where said centerline intersects said base line, said protractor being marked out on a generally trapezoidal-shaped layout, having a narrow top side parallel to said base line and extending in equal amounts from opposite sides of said centerline, first and second oblique sides converging toward one another from said base line to said top side at a first predetermined angle, and the intersection of said first and second oblique sides with the ends of said top side making a second predetermined angle with respect to the base line of said protractor as measured from the origin thereof;

a hole located at the origin of said protractor to permit the passage of the point of a pencil therethrough; and a plurality of spaced holes through said tool aligned with predetermined marks of said half-scale ruler, said holes being dimensioned to permit the passage of the point of a pencil therethrough for drawing circles.

2. The combination according to claim 1 further including a first visibly marked full scale marked in units along one of said first and second reference edges, having a full-scale zero-point at the mid-point of such reference edge; wherein said centerline intersects both said full-scale zero-point and said half-scale zero-point.

3. The combination according to claim 2 further including a second visibly marked full scale along said one reference edge parallel to said first visibly marked full scale, wherein said first visibly marked full scale is marked off in increasing dimension from one end toward the other of said one reference edge and said second visibly marked full scale has full-scale units marked off in increasing dimension toward both ends of said one reference edge from said full-scale zero-point.

4. The combination according to claim 3 wherein said first predetermined angle is an angle of forty-five degrees, and said second predetermined angle is an angle of sixty degrees.

5. The combination according to claim 4 wherein said protractor includes angular markings on said tool along said first and second oblique sides and the top thereof.

6. The combination according to claim 5 wherein said angular markings of said protractor include a first set of angular markings extending from zero degrees through one hundred eighty degrees starting along said first oblique side, the top thereof, and terminating at the bottom of the second oblique side thereof; and a second set of angular markings marked off in increasing angular amounts from the point of intersection of said center line with the top of said protractor in opposite directions toward said base line.

7. The combination according to claim 6 further including a plurality of orifices cut through said transparent material in areas free of markings for facilitating the drawing of shapes defined by said orifices.

8. The combination according to claim 1 wherein said rectangular tool has dimensions of approximately 3" by 6".

* * * * *